US007261130B2

(12) United States Patent
Porter et al.

(10) Patent No.: US 7,261,130 B2
(45) Date of Patent: Aug. 28, 2007

(54) AUTOMATED PROCESS FOR COUNTING AND FILLING CONTAINERS WITH MEAT AND POULTRY PRODUCTS

(75) Inventors: Brian Porter, Watson, OK (US); Robert Scott, Fort Smith, AR (US)

(73) Assignee: Gainco, Inc., Gainesville, GA (US)

( * ) Notice: Subject to any disclaimer, the term of this patent is extended or adjusted under 35 U.S.C. 154(b) by 249 days.

(21) Appl. No.: 10/943,416

(22) Filed: Sep. 17, 2004

(65) Prior Publication Data

US 2005/0060955 A1 Mar. 24, 2005

(51) Int. Cl.
*B65B 1/04* (2006.01)

(52) U.S. Cl. ..... 141/129; 141/94; 141/83; 53/500

(58) Field of Classification Search ..... 141/129, 141/10, 313, 94, 83, 67; 53/493, 495, 498, 53/500, 501

See application file for complete search history.

(56) References Cited

U.S. PATENT DOCUMENTS 4,094,413 A * 6/1978 Altenpohl et al. ..... 209/592
4,286,679 A 9/1981 Schneider
4,621,664 A 11/1986 Pryor et al.
5,029,431 A * 7/1991 Weening et al. ..... 53/437
5,184,733 A 2/1993 Arnarson et al.
5,229,840 A 7/1993 Arnarson et al.
5,582,283 A 12/1996 Arnarson
5,671,787 A * 9/1997 Wehrmann ..... 141/134
5,758,477 A * 6/1998 Wilson et al. ..... 53/500
5,871,078 A * 2/1999 Arnarson et al. ..... 198/358
5,971,037 A 10/1999 Ansaloni
6,066,037 A 5/2000 Arnason
6,138,817 A 10/2000 Hjalmarsson et al.
6,164,174 A 12/2000 Sigurdsson et al.
6,321,135 B1 11/2001 Asgeirsson
6,433,288 B1 8/2002 Olafsson
6,546,304 B2 4/2003 Thorvaldsson et al.
6,684,914 B2 2/2004 Gershman et al.
2003/0036344 A1 2/2003 Sigurdsson et al.

FOREIGN PATENT DOCUMENTS

WO WO 02/054876 A2 7/2002

* cited by examiner

*Primary Examiner*—Steven O. Douglas
(74) *Attorney, Agent, or Firm*—Tarolli, Sundheim, Covell & Tummino LLP

(57) ABSTRACT

An apparatus for delivering desired counts of products to containers. The apparatus includes a conveyor for moving discrete product portions along a path of travel. A force detecting device located along the path of travel measures force applied to the force detecting device. A counter adds one to a product count each time a force in a product identifying range is measured. A directing structure directs the product portions into a first container until the product count reaches a desired container count and directs the product portions into a second container after the product count reaches the desired container count.

32 Claims, 8 Drawing Sheets

AUTOMATED PROCESS FOR COUNTING AND FILLING CONTAINERS WITH MEAT AND POULTRY PRODUCTS

FIELD OF THE INVENTION

The present invention concerns food product portion counting. More particularly, the present invention concerns food product portion counting using a force detecting device.

BACKGROUND ART

Meat, poultry and fish processors have difficulty accurately filling boxes, bags or other containers with fixed quantities or counts of fresh, frozen or cooked products. Under filling a container can cause customer dissatisfaction and overfilling a container results in costly "give away" of expensive products. At present, most operations are manual in nature and involve utilizing operators to count the products and then fill the respective containers. Manual counting and filling has several disadvantages. For example, miscounts due to operator error occur. Manual counting and filling is labor intensive, resulting in a high cost per container and less than desired container filling rates.

Attempts have been made to automate the counting and filling process by utilizing electrical photoeye counting systems to count the products as they pass by on a moving conveyor belt. The process is initiated with operators filling the pockets of a moving, pocketed conveyor belt with a single product per pocket. Photoeyes, used in conjunction with a control system and located near the exit of the conveyor belt, are used to directly count the product in each pocket as they pass by. Once the desired count is achieved, the controller will cause the product coming off the exit of the conveyor to divert to a new package or container.

Several problems are associated with photoeye counting systems. The photoeye can be blocked by pieces of skin, loose breading, fat, water droplets or other by-products from meat. It is difficult to set up the photoeyes and an associated control system to consistently detect and count meat products that vary in size, shape, height and position within the pocket. Optimum container filling rates are not achieved, due to time allowed for the actuation of the product diverter and the container indexing device.

SUMMARY OF THE INVENTION

The present invention concerns a method and apparatus for delivering desired counts of product portions into containers. In the method, discrete product portions are moved into engagement with a force detecting device. Force applied to the force detecting device is repeatedly measured. One is added to the product count each time a force in a product identifying range is measured. The product portions are then directed into a first container until the product count reaches a desired container count. The product portions are directed into a second container after the product count reaches the desired container count.

One apparatus for delivering desired counts of product portions to containers includes a conveyor, a force detecting device, a counter, and a directing structure. The conveyor moves discrete product portions along a portion of a path of travel. The force detecting device is located along the path of travel and measures force applied to the force detecting device. The counter that adds one to the product count each time a force in a product identifying range is measured. The directing structure directs the product portions into a first container until the product count reaches the desired container count and directs the product portions into a second container after the product count reaches the desired container count.

In one embodiment, the speed of the conveyor is slowed during a transition period when product portions begin to be directed to the second container. The desired count per container, the minimum and maximum forces that define the product identifying range, and the desired number of containers to be filled for a particular product order may be selected by an operator using a user input device.

In one embodiment, miscounts are detected. A miscount occurs when an operator places two or more product portions in a single conveyor space. A miscount may be identified when a force greater than a maximum force of the product identified range is measured. A miscount may also be identified by measuring times between engagements of product portions with the force detection device. A miscount is detected when a measured time is less than a predefined minimum time between engagements.

Detection of a miscount may be handled in a variety of ways. In one embodiment, the count is automatically corrected when a miscount occurs. For example, two (one for the original product count and one for the additional product portion) may be added to the product count when a miscount is detected. In another embodiment, the container that includes a miscount is identified or flagged. The operator can then check the container count and add or remove product portions accordingly. In one embodiment, the flow of product portions to a flagged miscount container is stopped, the count is reset, and product portions are sent to another container.

These and other objects and advantages of the system constructed in accordance with an exemplary embodiment of the invention is more completely described in conjunction with the accompanying drawings.

DETAILED DESCRIPTION

Figure 3:
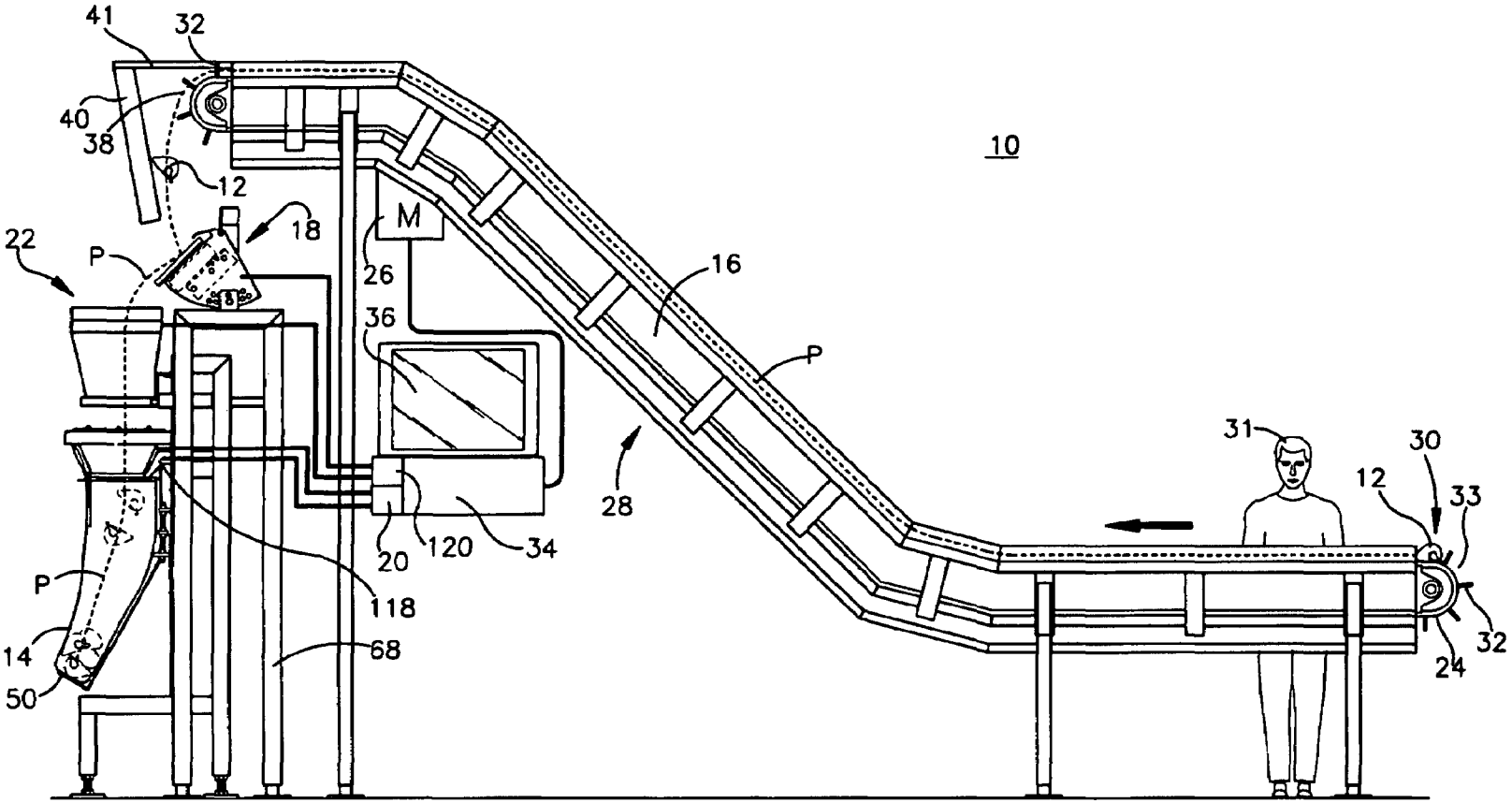
FIG. 3 is a side elevational view of an apparatus for counting and filling containers with product portions.

The present disclosure is directed to a method and apparatus 10 for delivering desired counts of product portions 12 to containers 14. Examples of product portions include poultry, beef, pork, and fish portions. The apparatus 10 includes a conveyor 16, a force detecting device 18, a counter 20, and a directing structure 22. Referring to FIG. 3, the conveyor 16 moves discrete product portions along a path of travel P. The force detecting device 18 is located along the path of travel of the product portions 12. The force detecting device 18 measures force applied to the force detecting device by product portions 12 that impact the force detecting device. The counter 20 adds one to a product count each time a force in a product identifying range is measured by the force detecting device 18. The directing structure 22 directs the product portions 12 into a first container 14 until the product count reaches a desired container count. Once the desired count in the first container is achieved, the directing structure 22 directs the product portions into a second container and the counter 20 counts the product portions delivered into the second container.

Figure 1:
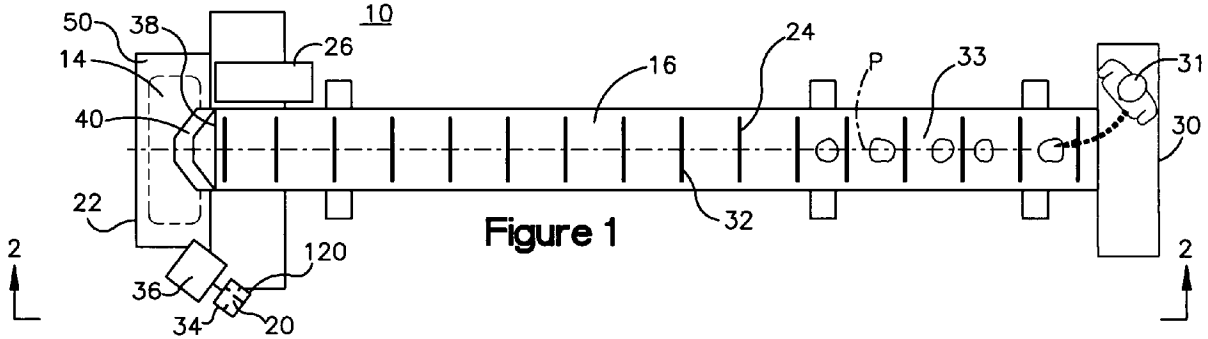
FIG. 1 is a plan view of an apparatus for counting and filling containers with product portions.
Figure 2:
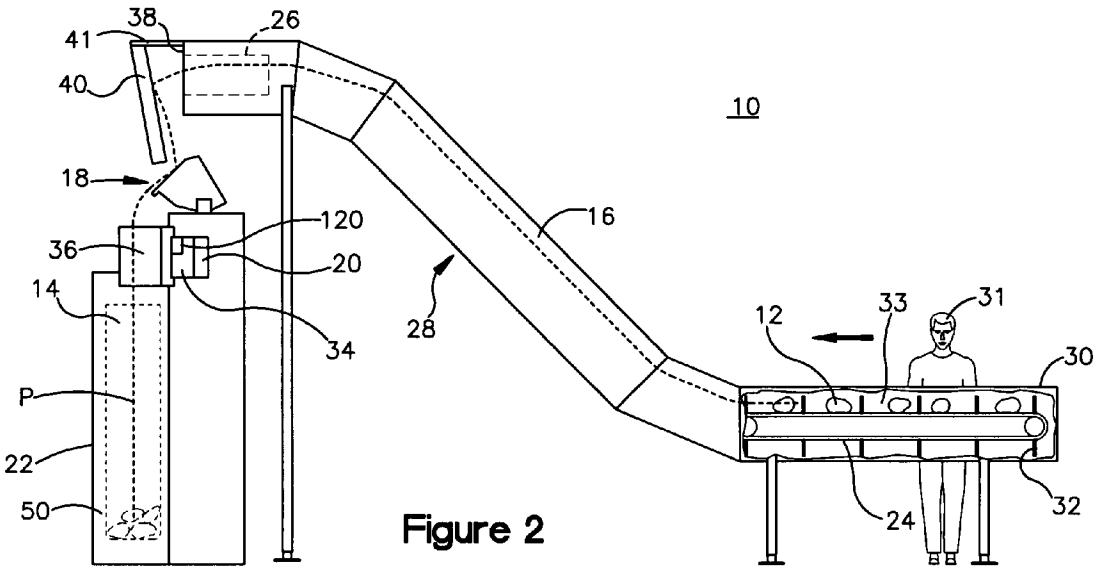
FIG. 2 is a view taken along the plane indicated by lines 2-2 in FIG. 1.

Referring to FIGS. 1-3, the product portions 12 travel along the path of travel P from a loading station 30 to a packaging station 50. The path of travel P starts at the loading station 30 where operator(s) 31 place product portions 12 on the conveyor. The product portions are moved along the path of travel P by the conveyor 16 to a conveyor end 38. The product portions 12 fall off the conveyor end 38 and are directed by a guide 40 into the force detecting device 18. The portions deflect off of the force detecting device 18 and fall into the directing structure 22. The product portions 12 fall from the directing structure 22 into the packaging station 50.

Referring to FIGS. 1-3, the illustrated conveyor 16 includes a flighted belt 24 that is driven by a motor 26. The flighted belt allows the product portions to be moved up a hill 28 as illustrated in FIGS. 2 and 3. In one embodiment, operator(s) at the loading station 30 are instructed to place one product portion 12 in each pocket 33 of the flighted belt 24. When the apparatus 10 is included in a line for packaging a single type or general size of product portion, the spacing between vanes 32 of the flighted belt is set to inhibit operator(s) from placing more than one product portion in a pocket 33.

In the exemplary embodiment, a controller 34 is in communication with the motor 26. The controller 34 controls the speed of the conveyor 16 as well as other functions of the apparatus 10. In the illustrated embodiment, the counter 20 is part of the controller 34. The controller 34 may slow a speed of the conveyor 16 during a transition period when product portions begin to be directed to the second container.

Referring to FIGS. 2 and 3, in the exemplary embodiment, a user input device 36, such as a touch screen, is in communication with the controller 34. The user input device allows an operator to input the desired count (number of product portions) per container 14. The user input device 36 allows a user to input minimum and maximum forces that define the product identifying range. The user input device allows a user to input a desired number of containers to be filled for a particular product.

Referring to FIGS. 2 and 3, the guide 40 directs the product portions into engagement with the force detecting device 18. The illustrated guide 40 is an elongated member that is bent to prevent product portions from moving laterally past the edges of the guide. The guide 40 is supported above the force detecting device at an angle by a support member 41 that extends from the conveyor 16. When product portions 12 fall from the conveyor end 38, the guide acts as a chute or slide that directs the product portions into contact with the force detecting device 18.

Figure 4:
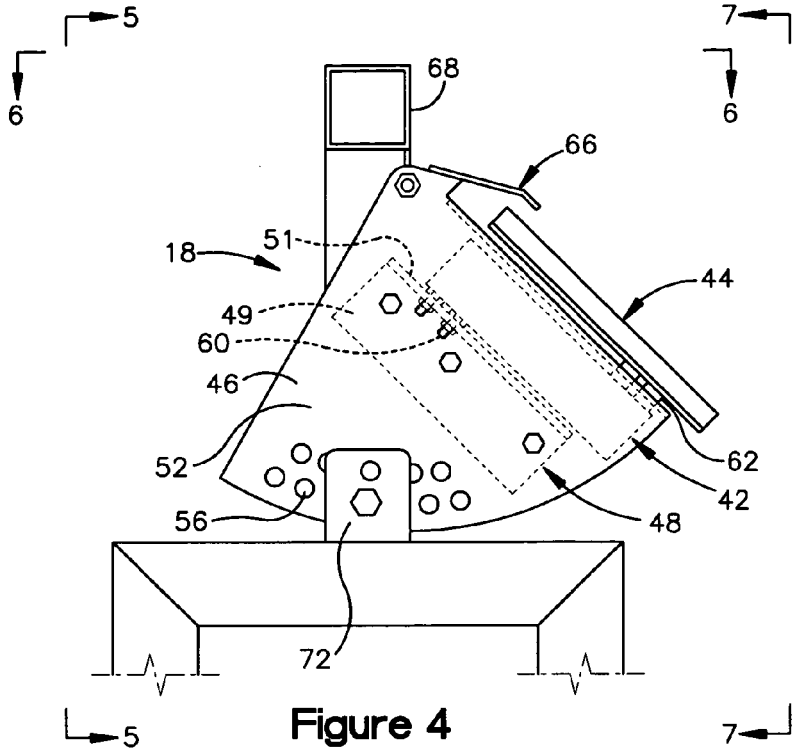
FIG. 4 is an enlarged portion of FIG. 3 showing a force detecting device.
Figure 5:
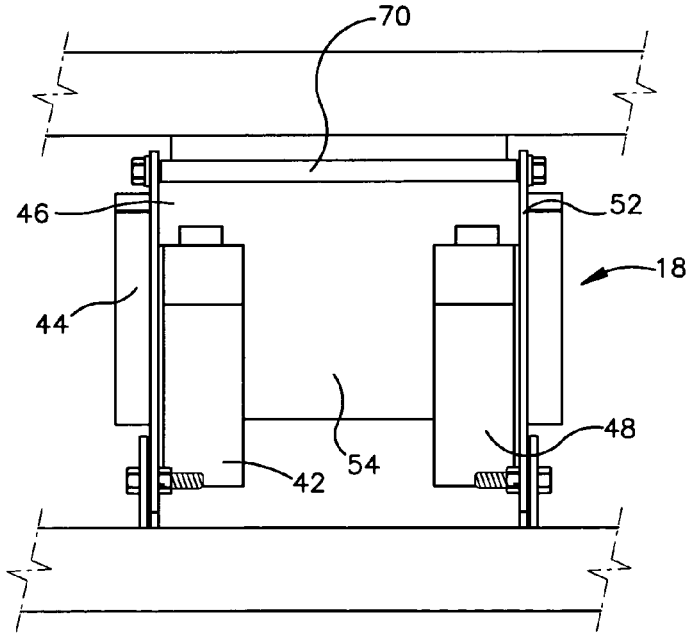
FIG. 5 is a view taken along the plane indicated by lines 5-5 in FIG. 4.
Figure 6:
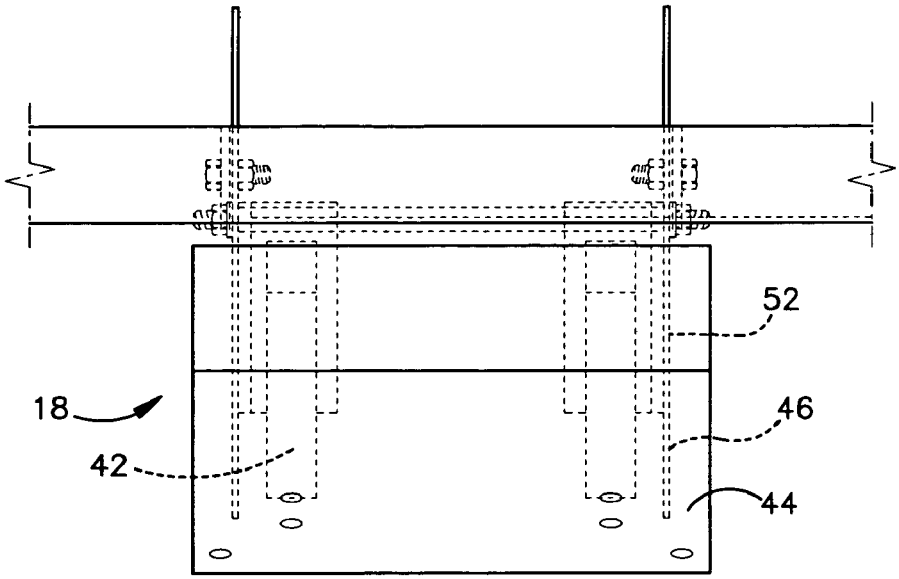
FIG. 6 is a view taken along the plane indicated by lines 6-6 in FIG. 4.
Figure 7:
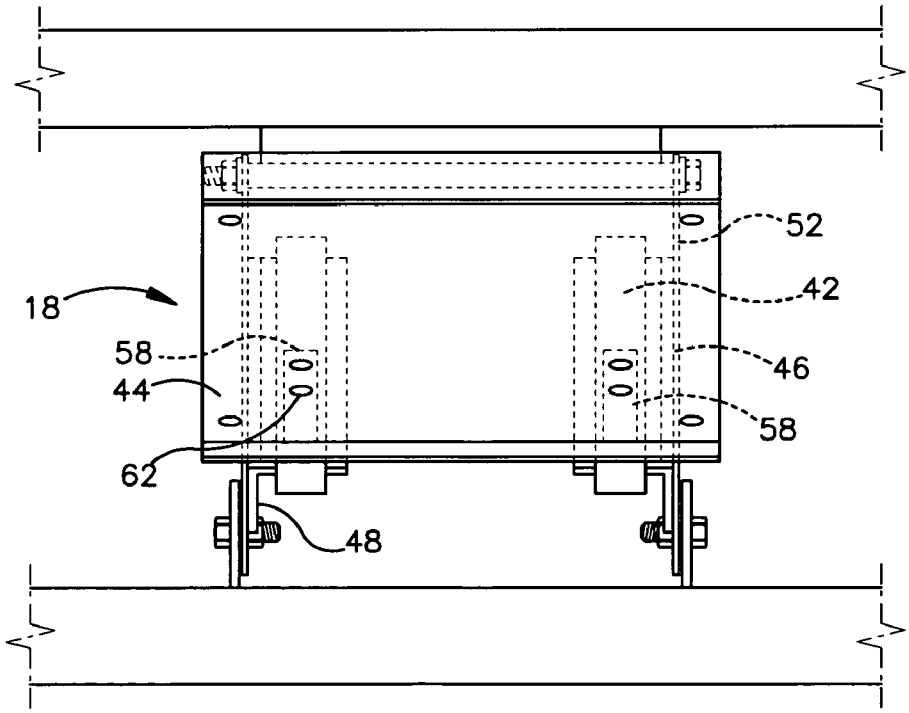
FIG. 7 is a view taken along the plane indicated by lines 7-7 in FIG. 4.
Figure 8:
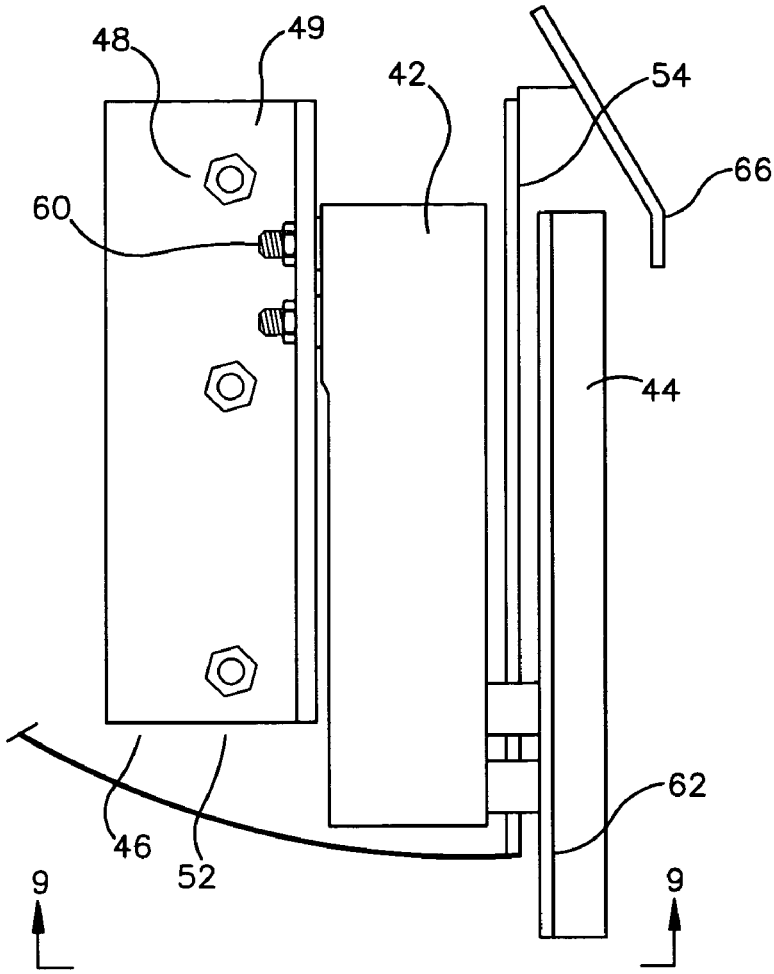
FIG. 8 is an enlarged portion of FIG. 4 showing components of one type of force detecting device.
Figure 9:
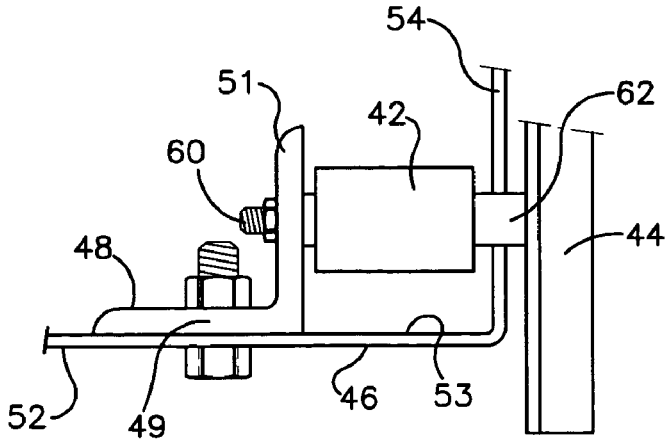
FIG. 9 is a view taken along the plane indicated by lines 9-9 in FIG. 8.
Figure 10:
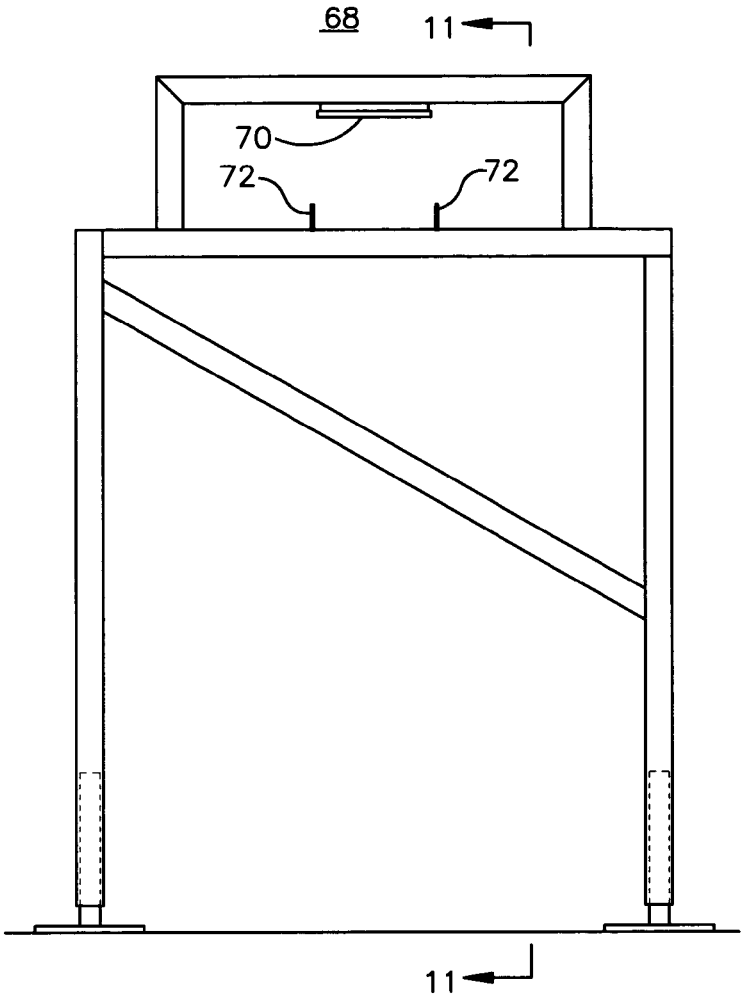
FIG. 10 is an elevational view of a force detecting device support frame.
Figure 11:
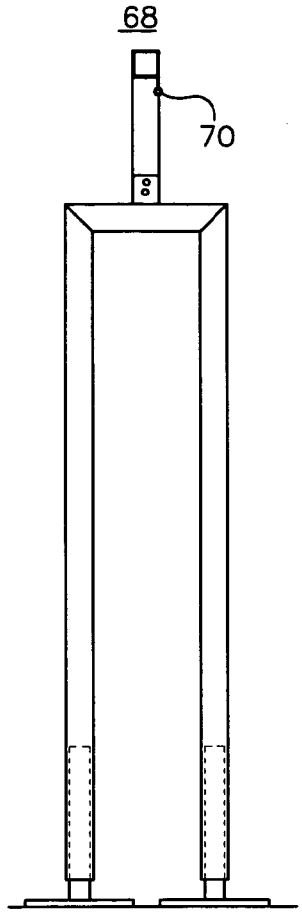
FIG. 11 is a view taken along the plane indicated by lines 11-11 in FIG. 10.

Referring to FIGS. 4-9, the illustrated force detection device 18 includes a pair of load cells 42, a product portion engagement platform 44, a frame 46, and a pair of support angles 48. The frame 46 includes a pair of side walls 52 that extend from a center wall 54. Referring to FIG. 4, a plurality of aligned holes 56 are included in the side walls. The holes 56 allow adjustment of the angle of the force detection device platform 44 with respect to the conveyor 16. The center wall 54 includes a pair of clearance slots 58 (FIG. 7) that allow attachment of the platform 44 to the load cells. The support angles 48 each include a first flange 49 that is attached to an inner surface 53 (FIG. 9) of a side walls 52 and a second flange 51. Each load cell 42 is connected to a support angle second flange 51 behind the center wall 54 by a pair of connections 60. An example of one type of load cell that could be used is HBM Model #PW15. In the illustrated embodiment, the pair of connections 60 space each load cell away from it respective support angle. For example, each connection 60 may include a 1/16" spacer between the load cell an the support angle. The platform 44 is connected to the pair of load cells 42 by a pair of connections 62. The pair of connections 62 extend through the clearance slots 58 and position the platform 44 in front of the center wall 54. For example, each connection 62 may include a ½" spacer that extends though a clearance slot 58.

Referring to FIGS. 3, 4, 10 and 11, a deflector plate 66 is attached to the side walls 52. The deflector plate 66 extends over the platform 44. Small pieces of product and other debris that become disposed in spaces between the platform 44 and the center wall 54, between the center wall 54 and the load cells 42, and/or between the load cells and the support angles 48 could adversely effect the forces detected by the force detecting device. The deflector plate 66 inhibits small pieces of product or other debris from entering these spaces.

In the illustrated embodiment, the force detecting device 18 is positioned with respect to the conveyor 16 and guide 40 by a framework 68. The framework includes an upper connection sleeve 70 and a pair of lower connection flanges 72. A fastener extends through the side walls 52 and the sleeve 70 to pivotally connect the force detecting device 18 to the framework. A pair of fasteners extend through the flanges 72 and a pair of aligned holes 56 in the side walls 52. The selection of the pair of aligned holes 56 determines the angle of the force detecting device 18 with respect to the conveyor 16 and guide 40. In the exemplary embodiment, the angle of the platform 44 is set such that the product portions that impact the platform 44 are directed to the directing structure 22.

Figure 12:
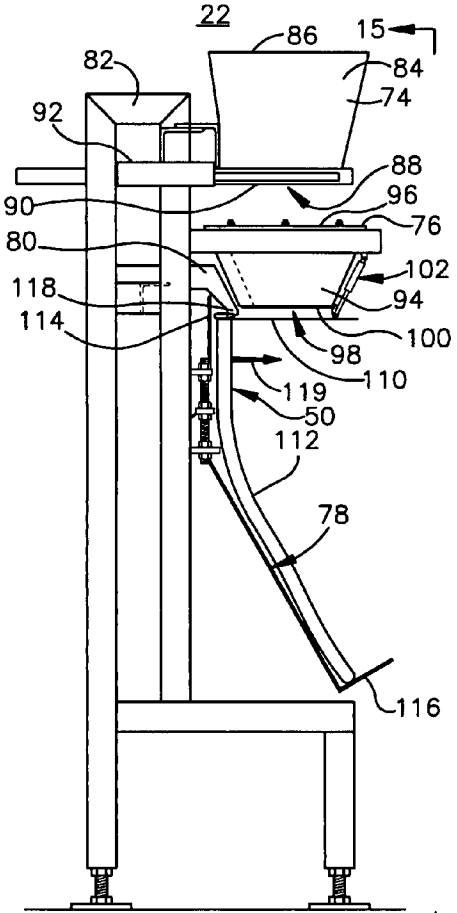
FIG. 12 is an elevational view of a directing structure for directing product portions into containers.
Figure 15:
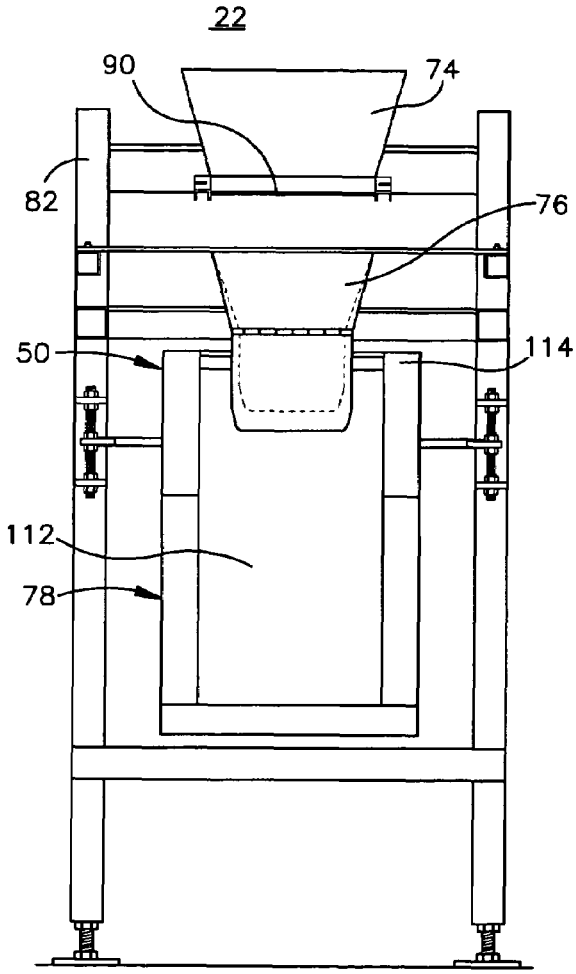
FIG. 15 is a view taken along the plane indicated by lines 15-15 in FIG. 12.
Figure 16:
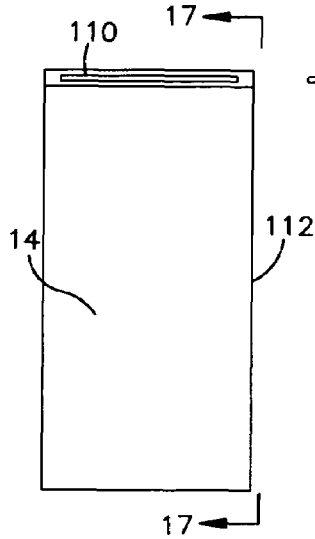
FIG. 16 is a view of a wicket of bags.
Figure 17:
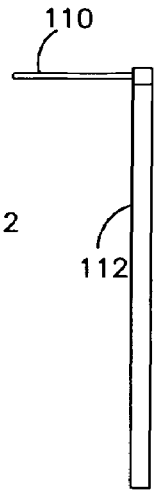
FIG. 17 is a view taken along the plane indicated by lines 17-17 in FIG. 16.

Referring to FIGS. 3 and 12-15, the illustrated directing structure 22 directs the product portions 12 from the platform 44 to containers 14. The directing structure could take a wide variety of forms without departing from the spirit and scope of the present invention. An example of one acceptable directing structure is illustrated. The illustrated directing structure 22 includes a buffer hopper 74, a bag hopper 76, a container support 78, a container opening device 80, and a framework 82. The buffer hopper 74 is positioned to accept product portions 12 from the force detecting device 18. Referring to FIG. 12, the buffer hopper 74 includes a receptacle 84 with an entrance opening 86 and an exit 88. The exit 88 includes a door 90 that is selectively openable (FIG. 14) and closable (FIG. 12) by an actuator 92. The actuator 92 is controlled by the controller 34 to selectively open or close the exit of the buffer hopper 74. In the illustrated embodiment, buffer hopper 74 is supported by the framework 86.

The bag hopper 76 is positioned beneath the buffer hopper 74 to accept product portions from the buffer hopper. Referring to FIGS. 12-15, the bag hopper 76 includes a receptacle 94 with an entrance opening 96 and an exit 98. The exit 98 includes a door 100 that is selectively openable (FIG. 14) and closable (FIG. 12) by an actuator 102. The actuator 102 is controlled by the controller 34 to selectively open or close the exit of the bag hopper 76. In the illustrated embodiment, bag hopper 76 is supported by the framework 86.

Referring to FIGS. 12-15, the illustrated container support 78 supports a wicket 110 of bags 112. The support 78 includes a wicket mount 114 and a lower support 116. The wicket mount 114 supports a wire wicket 110 loaded with bags 112. The lower support 116 supports bottoms of the bags 112 that are suspended by the wicket.

Figure 14:
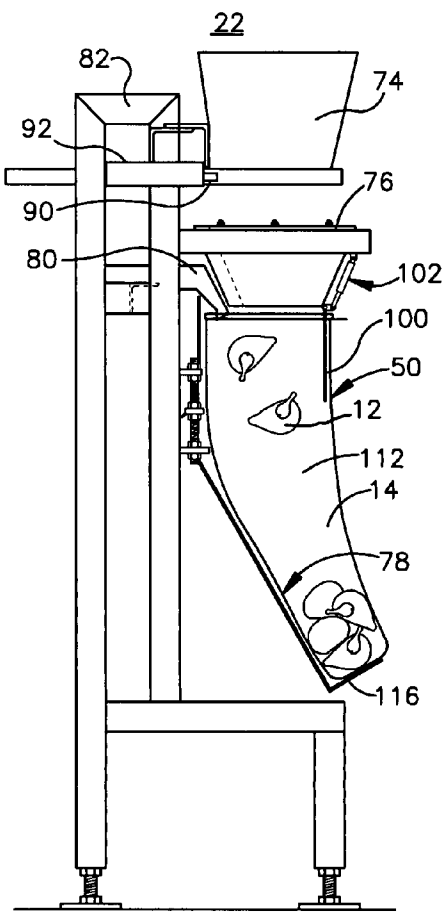
FIG. 14 is an elevational view of a directing structure for directing product portions into containers.
Figure 13:
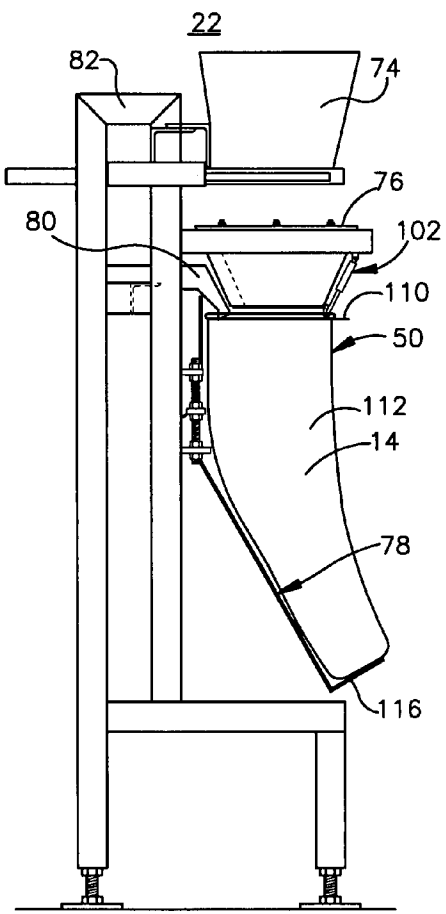
FIG. 13 is an elevational view of a directing structure for directing product portions into containers.

The illustrated container opening device 80 is a blower with a nozzle 118. Referring to FIG. 12, the nozzle 118 is positioned to blow air into a bag 112 pulled outward as indicated by arrow 119. Referring to FIG. 13, air blown into the bag 112 opens the bag 112 beneath the bag hopper 76. Referring to FIG. 14, the controller 34 opens the door 90 opens, which holds the bag open, allowing product portions 12 to fall from the bag hopper into the bag. The bag is maintained in an open condition by the door 90 until the desired count of product portions 12 is in the bag. The door 90 is closed and the bag is removed from the wickets when the desired count is reached. The next bag is then opened by the container opening device.

When the apparatus is first started, air is supplied to the to the nozzle 118 to open a bag 112. The controller 34 opens the buffer hopper 74 and the bag hopper 76. The bag hopper door holds the bag open. The controller 34 controls the motor 26 to begin movement of the flighted belt 24. An operator at the loading station 30 begins placing discrete product portions between pairs of conveyor vanes 32. The conveyor 16 moves the product portions to the guide 40. The product portions 12 slide down the guide into engagement with the force detecting device 18. The force detecting device measures the force applied by each portion and provides a corresponding signal to the controller each time an impact is sensed. The controller adds one to the product count each time a force in the product identifying range is measured. In one embodiment, the buffer hopper 74 and the bag hopper 76 remain open and product portions enter the first container until the product count reaches the preset count. In this embodiment, the product portions fall directly into the bag or contianer. In the exemplary embodiment, the controller closes the buffer hopper and the bag hopper 76 a predetermined time after the last product portion in the preset count impacts the force detecting device. This predetermined time delay allows the last product portion in the count to fall into the bag. Once the last product portion in the count falls into the opened bag, the controller closes the bag hopper 76 and the buffer hopper 74. The conveyor 16 continues to run and product portions accumulate in the buffer hopper 74 as an operator removes the filled bag. The apparatus 10 continues to run and provide product portions 12 into the buffer hopper 74 until a predetermined buffer full count is reached. The buffer count typically corresponds to the count of the next container to be filled. If a ready signal has not been received from an operator interface button that indicates the filled container has been removed, the conveyor is stopped until the signal is received by the controller. If the full container is removed and a ready signal is received by the controller before a buffer full count is reached, the buffer will open and product will continue to be fed to the force detecting device. Once the filled bag is removed, air is again supplied to the to the nozzle 118 to open a second bag 112. The controller 34 opens the buffer hopper 74 and the bag hopper 76 to drop the product portions in the buffer hopper into the second bag. In one embodiment, the speed of the conveyor is slowed during a transition period when product portions begin to be directed to the second container. Product portions are supplied to the second bag until the count for the second bag reached. This process is repeated for each container. In one embodiment, an additional staging or buffer hopper is included to reduce the number of times the conveyor is stopped.

In the illustrated embodiment, the flighted conveyor belt is manually loaded with one product portion 12 per pocket as the conveyor moves. The pockets 33 may be configured such that the pockets are wider and longer than the average product portion to provide a large target for easier loading. One downside of the larger pockets is that operators can accidentally load one pocket with two product portions. A miscount occurs when an operator places two or more product portions in a single conveyor space.

In the exemplary embodiment, the controller 34 is programmed to identify product portion miscounts. A miscount occurs when an operator places two or more product portions in a single conveyor space. If the impact of more than one product portion with the force detecting device is given a single count, the count for the container will be off (i.e. the processor will be "giving away" product portions). In the exemplary embodiment, the controller includes a timer 120 for measuring the time between impacts with the force detecting device. In the illustrated embodiment, the timer 120 is included in the controller 34.

The product portions of a double loaded pocket may be disposed in the conveyor pockets in a variety of different configurations. For example, the second product portion may be directly on top of the first product portion. The second product portion may be on the right or left side of the first product portion. The second product portion may be in front of or behind the first product portion.

In one embodiment, the controller is programmed to identify miscounts using the force applied to the force detecting device 18 and the time between impacts with the force detecting device. A force applied to the force detecting device that is greater than a predefined maximum force for a given type of product portion is indicative of a miscount due to double loading of a conveyor pocket. The controller will identify a product portion miscount when a force greater than a maximum product identifying force value is measured. For example, the controller may be programmed to identify a miscount when the measured force is approximately the force that would be applied if two product portions are stuck together.

A shorter than normal time between engagements of the force detecting element is also indicative of double loading of a conveyor pocket. The controller is programmed to identify a product portion miscount when the time between engagements of product portions with the force detection device is less than a predefined minimum time between engagements. For example, the controller may be programmed to identify a miscount when the time between engagements of product portions is between ⅓ to ½ of the standard time between engagements.

In the exemplary embodiment, the operator may select how the apparatus deals with miscounts via the user input device 36. One option available to the operator is to allow the controller to automatically correct the count based on input from the force detecting device when a product portion miscount is identified. For example, when the controller senses that two product portions were loaded into a single conveyor pocket the controller will automatically add two to the product count (rather than one) to correct the count.

A second option available to the operator is to allow the controller to finish filling the container when a miscount is detected, but provide an indication or flag that a miscount has been detected. The flagged container can then be inspected or weighed to determine whether a miscount actually occurred.

A third option available to the operator is to allow the controller to stop the flow of product portions into the first container when a miscount is detected, reset the product portion count, and direct product portions into another container. Under this option, the controller may also provide some indication or flag that the count for the first container is incorrect. The product portions in the first container may then be returned to the loading station 30 for loading into a subsequent container. This option eliminates time consuming recounts that can occur when a miscount is detected. This option is especially useful when the predefined count for a given container is high and the miscount is detected early on in the container filling process.

With each of these options, the controller keeps track of the double counts or the miscounts and allows the operator to access a report. In the exemplary embodiment, the user interface allows these options for responding to miscounts to be combined. For example, the user may request that the controller automatically correct the count and provide an indication that a miscount has occurred. The user may also set the controller up to take different actions depending on where in the count the miscount occurs. For example, if the miscount occurs early in the count (for example, product portion 10 of 100) filling of the container is stopped and filling of the next container begins. If the miscount occurs late in the count (for example, product portion 90 of 100) filling of the container is finished and the container is flagged.

In one embodiment, the user input device allows the operator to place the controller in a calibration mode. The calibration mode is available to set up the force detection minimums and maximums that represent the typical product portions impacting the force detection device 18. The calibration mode also allows the input of the typical time period between each impact. That is, how long it should take force detecting device impacts if each pocket is loaded with a product portion. The calibration mode allows the user to enter the desired count per container. The calibration mode allows the user to enter the desired to be filled for a particular product order is selectable by an operator.

While the invention has been described with a degree of particularity, it is the intent that the invention includes all modifications and alterations from the disclosed design falling within the spirit or scope of the appended claims.

The invention claimed is:

1. A method of delivering desired counts of product portions into containers, comprising:

a) moving discrete product portions along a conveyor into engagement with a force detecting device;

b) repeatedly measuring force applied to the force detecting device as discrete product portions engage said device;

c) adding one to a product count each time a force in a product identifying force range is measured;

d) directing the product portions into a first container until the product count reaches a desired container count;

e) directing the product portions into a second container after the product count reaches the desired container count; and f) slowing a speed of the conveyor during a transition period when product portions begin to be directed to the second container.

2. The method of claim 1 wherein the desired count per container is selectable by an operator.

3. The method of claim 1 wherein the minimum and maximum forces that define the product identifying range are selectable by an operator.

4. The method of claim 1 wherein the desired number of containers to be filled for a particular product order is selectable by an operator.

5. The method of claim 1 further comprising resetting the product count once the desired container count is reached.

6. An apparatus for delivering desired counts of product portions to containers, comprising:

a) a conveyor for moving discrete product portions along a path of travel;

b) a load cell supporting a platform located along the path of travel that measures force applied to the force detecting device;

c) a counter that adds one to a product count each time a force in a product identifying range is measured; and d) a directing structure for directing the product portions into a first container until the product count reaches a desired container count and directing the product portions into a second container after the product count reaches the desired container count.

7. The apparatus of claim 6 further comprising a user input for allowing a user to input the desired count per container.

8. The apparatus of claim 6 further comprising a user input for allowing a user to input minimum and maximum forces that define the product identifying range.

9. The apparatus of claim 6 further comprising a user input for allowing a user to input a desired number of containers to be filled for a particular product.

10. The apparatus of claim 6 wherein a position and angle of the platform is adjustable with respect to the conveyor.

11. A method of identifying product portion miscounts, comprising:

a) moving product portions into engagement with a force detecting device;

b) repeatedly measuring force applied to the force detecting device;

c) adding one to a product count when a force above a minimum product identifying value is measured; and d) identifying a miscount when a force greater than a maximum product identifying value is measured.

12. The method of claim 11 further comprising adding an additional one to the product count when a force greater than a maximum product identifying value is measured.

13. A method of identifying product portion miscounts, comprising:

a) moving product portions into engagement with a force detecting device;

b) repeatedly measuring force applied to the force detecting device;

c) adding one to a product count when a force above a minimum product identifying value is measured;

d) measuring times between engagements of product portions with the force detection device; and e) identifying a miscount when a measured time is less than a predefined minimum time between engagements.

14. The method of claim 13 further comprising correcting the count based on the measured times and input from the force detecting device when a product portion miscount is identified.

15. An apparatus for identifying product portion miscounts, comprising:

a) a conveyor for moving discrete product portions along a path of travel;

b) a force detecting device located along the path of travel that measures force applied to the force detecting device;

c) a counter that adds one to a product count each time the force detecting device measures a minimum product identifying force value; and d) a controller coupled to the force detecting device, the controller being programmed to identify product portion miscounts based on input from the force detecting device.

16. The apparatus of claim 15 wherein the controller is programmed to identify a product portion miscount when a force greater than a maximum product identifying force value is measured.

17. The apparatus of claim 15 wherein the controller is programmed to identify a product portion miscount when a time between engagements of product portions with the force detection device is less than a predefined minimum time between engagements.

18. The apparatus of claim 15 wherein the controller is programmed to correct the count based on input from the force detecting device when a product portion miscount is identified.

19. A method of delivering desired counts of product portions into containers, comprising:

a) moving discrete product portions into engagement with a force detecting device;

b) repeatedly measuring force applied to the force detecting device as discrete product portions engage said device;

c) adding one to a product count each time a force in a product identifying force range is measured;

d) directing the product portions into a first container until the product count reaches a desired container count;

e) directing the product portions into a second container after the product count reaches the desired container count; and f) identifying a miscount when a force greater than a maximum force of the product identified range is measured.

20. A method of delivering desired counts of product portions into containers, comprising:

a) moving discrete product portions into engagement with a force detecting device;

b) repeatedly measuring force applied to the force detecting device as discrete product portions engage said device;

c) adding one to a product count each time a force in a product identifying force range is measured;

d) adding two to the product count when a force greater than a maximum force of the identified range is measured;

e) directing the product portions into a first container until the product count reaches a desired container count; and f) directing the product portions into a second container after the product count reaches the desired container count.

21. The method of claim 20 wherein the desired count per container is selectable by an operator.

22. A method of delivering desired counts of product portions into containers, comprising:

a) moving discrete product portions into engagement with a force detecting device;

b) repeatedly measuring force applied to the force detecting device as discrete product portions engage said device;

c) adding one to a product count each time a force in a product identifying force range is measured;

d) directing the product portions into a first container until the product count reaches a desired container count;

e) directing the product portions into a second container after the product count reaches the desired container count; and f) measuring times between engagements of product portions with the force detection device and identifying a miscount when a measured time is less than a predefined minimum time between engagements.

23. A method of delivering desired counts of product portions into containers, comprising:

a) moving discrete product portions into engagement with a force detecting device;

b) repeatedly measuring force applied to the force detecting device as discrete product portions engage said device;

c) adding one to a product count each time a force in a product identifying force range is measured;

d) measuring times between engagements of product portions with the force detection device and adding two to the product count when a measured time is less than a predefined minimum time between engagements;

e) directing the product portions into a first container until the product count reaches a desired container count; and f) directing the product portions into a second container after the product count reaches the desired container count.

24. The method of claim 23 wherein the minimum and maximum forces that define the product identifying range are selectable by an operator.

25. A method of delivering desired counts of product portions into containers, comprising:

a) moving discrete product portions into engagement with a force detecting device;

b) repeatedly measuring force applied to the force detecting device as discrete product portions engage said device;

c) adding one to a product count each time a force in a product identifying force range is measured;

d) directing the product portions into a first container until the product count reaches a desired container count;

e) directing the product portions into a second container after the product count reaches the desired container count; and f) detecting a miscount by monitoring force applied to the force detection device, stopping a flow of product portions into the first container when a miscount is detected, resetting the product portion count, and directing product portions into the second container.

26. The method of claim 25 wherein the minimum and maximum forces that define the product identifying range are selectable by an operator.

27. An apparatus for delivering desired counts of product portions to containers, comprising:

a) a conveyor for moving discrete product portions along a path of travel;

b) a force detecting device located along the path of travel that measures force applied to the force detecting device;

c) a counter that adds one to a product count each time a force in a product identifying range is measured;

d) a directing structure for directing the product portions into a first container until the product count reaches a desired container count and directing the product portions into a second container after the product count reaches the desired container count; and e) a conveyor speed controller for slowing a speed of the conveyor during a transition period when product portions begin to be directed to the second container.

28. An apparatus for delivering desired counts of product portions to containers, comprising:

a) a conveyor for moving discrete product portions along a path of travel;

b) a force detecting device located along the path of travel that measures force applied to the force detecting device;

c) a counter that adds one to a product count each time a force in a product identifying range is measured;

d) a directing structure for directing the product portions into a first container until the product count reaches a desired container count and directing the product portions into a second container after the product count reaches the desired container count; and e) a controller coupled to the force detecting device programmed to identify a miscount when a force greater than a maximum force of the product identified range is measured.

29. An apparatus for delivering desired counts of product portions to containers, comprising:

a) a conveyor for moving discrete product portions along a path of travel;

b) a force detecting device located along the path of travel that measures force applied to the force detecting device;

c) a counter that adds one to a product count each time a force in a product identifying range is measured;

d) a controller coupled to the force detecting device programmed to add two to the product count when a force greater than a maximum force of the identified range is measured; and e) a directing structure for directing the product portions into a first container until the product count reaches a desired container count and directing the product portions into a second container after the product count reaches the desired container count.

30. An apparatus for delivering desired counts of product portions to containers, comprising:

a) a conveyor for moving discrete product portions along a path of travel;

b) a force detecting device located along the path of travel that measures force applied to the force detecting device;

c) a counter that adds one to a product count each time a force in a product identifying range is measured;

d) a directing structure for directing the product portions into a first container until the product count reaches a desired container count and directing the product portions into a second container after the product count reaches the desired container count; and e) a timer coupled to the force detecting device for measuring times between engagements of product portions with the force detection device and a controller coupled to the timer programmed to identify a miscount when a measured time is less than a predefined minimum time between engagements.

31. An apparatus for delivering desired counts of product portions to containers, comprising:

a) a conveyor for moving discrete product portions along a path of travel;

b) a force detecting device located along the path of travel that measures force applied to the force detecting device;

c) a counter that adds one to a product count each time a force in a product identifying range is measured;

d) a timer coupled to the force detecting device for measuring times between engagements of product portions with the force detection device and a controller coupled to the timer programmed to add two to the product count when a measured time is less than a predefined minimum time between engagements; and e) a directing structure for directing the product portions into a first container until the product count reaches a desired container count and directing the product portions into a second container after the product count reaches the desired container count.

32. An apparatus for delivering desired counts of product portions to containers, comprising:

a) a conveyor for moving discrete product portions along a path of travel;

b) a force detecting device located along the path of travel that measures force applied to the force detecting device;

c) a counter that adds one to a product count each time a force in a product identifying range is measured;

d) a directing structure for directing the product portions into a first container until the product count reaches a desired container count and directing the product portions into a second container after the product count reaches the desired container count; and e) a controller coupled to the force detecting device programmed to detect a miscount by monitoring force applied to the force detection device and upon detection of a miscount to: i) stop a flow of product portions into the first container when a miscount is detected; ii) reset the product portion count; and iii) direct product portions into the second container.

* * * * *

UNITED STATES PATENT AND TRADEMARK OFFICE

CERTIFICATE OF CORRECTION

PATENT NO. : 7,261,130 B2
APPLICATION NO. : 10/943416
DATED : August 28, 2007
INVENTOR(S) : Brian Porter and Robert Scott It is certified that error appears in the above-identified patent and that said Letters Patent is hereby corrected as shown below:

On the title page item [60] of the patent, add the following:

--Related U.S. Application Data

Provisional application No. 60/505,664, filed on Sept. 24, 2003--

Signed and Sealed this

Twentieth Day of November, 2007

JON W. DUDAS
*Director of the United States Patent and Trademark Office*